US007450733B2

(12) United States Patent
Suprapmo et al.

(10) Patent No.: US 7,450,733 B2
(45) Date of Patent: Nov. 11, 2008

(54) SPEAKER WITH EXTERNALLY MOUNTED ACOUSTIC EXTENSION

(75) Inventors: Susimin Suprapmo, Singapore (SG); Choon Yen Frankie Shee, Bukit Merah Central (SG); Thean Kule Christopher Chang, Singapore (SG); Kin Fui Chong, Choa Chu Kang Central (SG)

(73) Assignee: Creative Technology Ltd., Singapore (SG)

( * ) Notice: Subject to any disclaimer, the term of this patent is extended or adjusted under 35 U.S.C. 154(b) by 658 days.

(21) Appl. No.: 10/764,172

(22) Filed: Jan. 23, 2004

(65) Prior Publication Data

US 2005/0163334 A1 Jul. 28, 2005

(51) Int. Cl.
*H04R 1/02* (2006.01)
*H04R 1/20* (2006.01)

(52) U.S. Cl. ..... 381/337; 381/338; 381/341; 381/345; 381/348; 381/351; 381/395; 381/396

(58) Field of Classification Search ..... 381/337, 381/338, 341, 345, 349, 350, 395, 396, 397, 381/351; 181/152, 153, 197, 196, 198, 199, 181/156, 160
See application file for complete search history.

(56) References Cited

U.S. PATENT DOCUMENTS

| | | | | | |
|---|---|---|---|---|---|
| 2,971,598 | A | | 2/1961 | Sieler | |
| 3,327,808 | A | * | 6/1967 | Shaper | 181/153 |
| 3,778,551 | A | | 12/1973 | Grodinsky | |
| 4,126,204 | A | * | 11/1978 | Ogi et al. | 181/156 |
| 4,142,603 | A | * | 3/1979 | Johnson | 181/148 |
| 4,168,761 | A | * | 9/1979 | Pappanikolaou | 181/156 |
| 4,210,778 | A | | 7/1980 | Sakurai et al. | |
| 4,299,304 | A | | 11/1981 | Rebsch | |
| 4,440,260 | A | | 4/1984 | Jacobsen | |
| 4,509,615 | A | | 4/1985 | Hruby | |
| 4,889,208 | A | * | 12/1989 | Sugihara | 181/148 |
| 5,025,474 | A | * | 6/1991 | Tanaka et al. | 381/333 |
| 5,082,084 | A | * | 1/1992 | Ye-Ming | 181/153 |
| 5,197,103 | A | | 3/1993 | Hayakawa | |
| 5,357,586 | A | | 10/1994 | Nordschow et al. | |
| 5,373,564 | A | * | 12/1994 | Spear et al. | 381/352 |
| 5,517,573 | A | * | 5/1996 | Polk et al. | 381/345 |
| 5,533,132 | A | * | 7/1996 | Button | 381/332 |
| 5,809,154 | A | * | 9/1998 | Polk | 381/345 |
| 5,821,471 | A | * | 10/1998 | McCuller | 181/156 |
| 5,824,969 | A | * | 10/1998 | Takenaka | 181/156 |
| 6,078,676 | A | * | 6/2000 | Takenaka | 381/338 |
| 6,144,751 | A | | 11/2000 | Velandia | |
| 6,411,721 | B1 | * | 6/2002 | Spindler | 381/349 |
| 6,504,938 | B1 | * | 1/2003 | Anderson et al. | 381/335 |
| 6,549,637 | B1 | | 4/2003 | Risch | |
| 6,604,602 | B1 | | 8/2003 | Kim | |
| 6,634,455 | B1 | * | 10/2003 | Yang | 181/156 |

(Continued)

*Primary Examiner*—Wayne Young
*Assistant Examiner*—Dionne H Pendleton
(74) *Attorney, Agent, or Firm*—Blakely, Sokoloff, Taylor & Zafman LLP

(57) ABSTRACT

A speaker comprises an enclosure with at least one wall; and an acoustic driver mounted in an interior of the enclosure and being attached to a front wall of the enclosure. An acoustic extension is mounted to the enclosure and is external of the enclosure. The acoustic extension is operatively connected to the interior of the enclosure; and comprises one of: a bass reflex port, a tuned port, a passive radiator, and a concentric loading.

40 Claims, 5 Drawing Sheets

U.S. PATENT DOCUMENTS 6,973,994 B2 * 12/2005 Mackin et al. ..... 181/156
7,039,212 B2 * 5/2006 Poling et al. ..... 381/349
7,162,049 B2 * 1/2007 Polk, Jr. ..... 381/345

* cited by examiner

SPEAKER WITH EXTERNALLY MOUNTED ACOUSTIC EXTENSION

FIELD OF THE INVENTION

This invention relates to a speaker with an externally-mounted acoustic extension and refers particularly, though not exclusively, to such a speaker where the speaker enclosure is relatively small.

BACKGROUND OF THE INVENTION

Bass reflex speakers have been known for some time. The enhanced low frequency response is due to the use of a port that is built-in to the speaker enclosure. That tends to make the speaker enclosure larger than would otherwise be the case due to the length of port required, the port generally having an outlet in the front wall of the speaker enclosure.

With the use of small speaker enclosures in, for example, home theatre systems, computers sound systems, MP3 players, and the like producing an acceptable low-frequency response with small enclosures has been difficult.

A passive radiator may be used but the small surface area of small enclosures becomes a significant limiting factor. Also a small piston diameter of the passive radiator decreases the sound pressure level at low frequencies.

Finally, small speaker enclosures have an increased tendency towards overheating due to the low volume of air able to dissipate the heat generated within the speaker enclosure.

SUMMARY OF THE INVENTION

In accordance with a preferred aspect of the invention there is provided a speaker comprising:

(a) an enclosure with at least one wall;

(b) an acoustic driver mounted in an interior of the enclosure and being attached to a front wall of the enclosure;

(c) an acoustic extension being mounted to the enclosure;

(d) the acoustic extension being external of the enclosure and being operatively connected to the interior of the enclosure.

In a further preferred aspect, there is provided an acoustic extension for external attachment to a speaker, the acoustic extension comprising:

(a) a central stem, and (b) a plurality of columns each being concentric with the central stem;

(c) the plurality of columns being mounted to an outer wall and an inner wall in an alternating and opposed manner to define therebetween an airflow passage operatively connected to the central stem and operably connectable to an interior of the speaker.

In a final preferred aspect there is provided a speaker comprising;

(a) an enclosure with at least one wall;

(b) an acoustic driver mounted in an interior of the enclosure and being attached to a front wall of the enclosure;

(c) an acoustic extension being mounted to the enclosure externally of the enclosure and being operatively connected to the interior of the enclosure;

(d) the enclosure and a frame of the acoustic driver being made of a heat conductive material;

(e) the acoustic extension having an outlet air gap facing towards the enclosure to provide a cooling airflow over at least a part of the enclosure.

For all forms, the acoustic extension may be mounted in an opening in a rear wall of the enclosure and may be co-axial with the acoustic driver. Alternatively, the central stem may be mounted in an opening in a lower side wall of the enclosure, the acoustic extension acting as a pedestal for the enclosure.

In the first and final forms, the acoustic extension may comprise a central stem, and a plurality of columns each being concentric with the central stem; the plurality of columns being mounted to an outer wall and an inner wall in an alternating and opposed manner to define therebetween an airflow passage operatively connected to the central stem and the interior.

For all forms, the plurality of columns may comprise an inner column mounted to the outer wall and extending towards the inner wall, there being an air gap between a free end of the inner column and the inner wall.

Additionally or alternatively, the plurality of columns may comprise an intermediate column mounted to the inner wall and extending towards the outer wall, there being an air gap between a free end of the intermediate column and the outer wall.

Further additionally or alternatively, the plurality of columns may comprise an outer column mounted to the outer wall and extending to a plane of the inner wall, there being an outlet air gap between the outer column and the inner wall.

Preferably, the outlet air gap faces towards the enclosure. All junctions between each of the plurality of columns and each of the outer wall and inner wall may be curved.

Preferably, the enclosure comprises four mutually perpendicular side walls, the four mutually perpendicular side walls being extended to comprise the intermediate column. The outer column may extend forwardly to a plane of the front wall.

The central stem may define an air volume, the air volume and the airflow passage preferably being of a constant acoustic area.

The acoustic extension may be adjustable relative to the wall, the adjustment being in a direction of a longitudinal axis of the central stem. The acoustic extension may be removably attached to the enclosure.

The enclosure and a frame of the acoustic driver may be made of a heat conductive material.

The acoustic extension may be any one of: a bass reflex port, a tuned port, a passive radiator, or a concentric loading.

BRIEF DESCRIPTION OF THE DRAWINGS

In order that the invention may be clearly understood and readily put into practical effect, there shall now be described by way of non-limitative example, only preferred embodiments of the present invention, the description being with reference to the accompanying illustrative drawings in which.

DETAILED DESCRIPTION OF THE PREFERRED EMBODIMENTS

Figure 3:
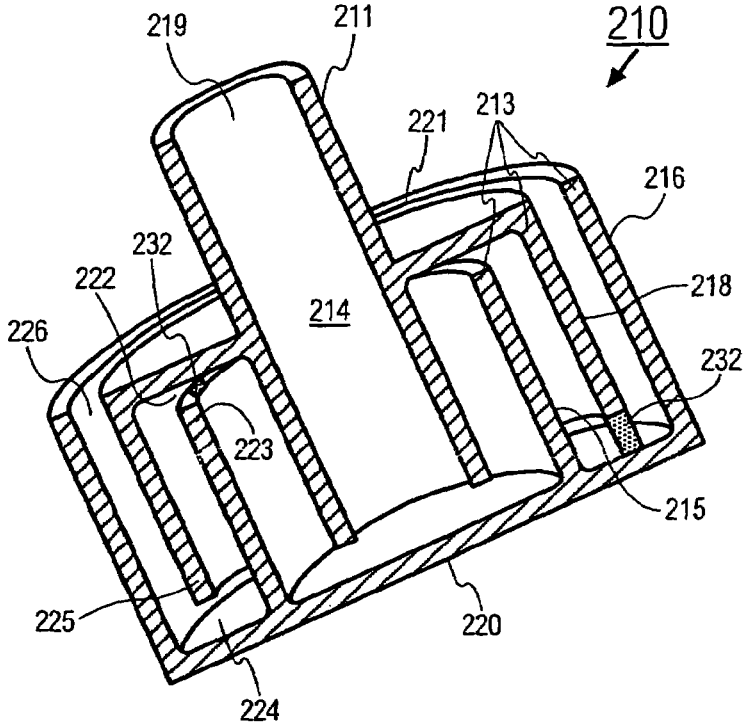
FIG. 3 is a perspective cross sectional view of the external acoustic extension of FIG. 2.
Figure 4A:
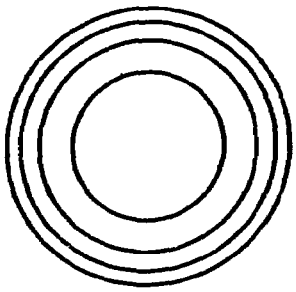
FIGS. 4 *a, b, c, d* are cross sectional views of various external acoustic extension.
Figure 4B:
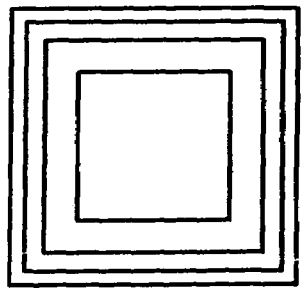
Figure 4C:
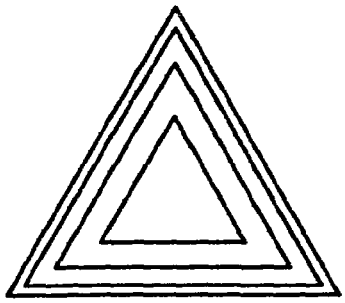
Figure 4D:
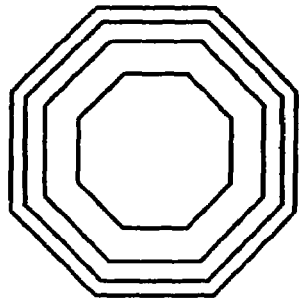

Throughout the drawings like components have like reference numerals but with a prefix number indicating the Figure number (except for FIG. 3).

Figure 1:
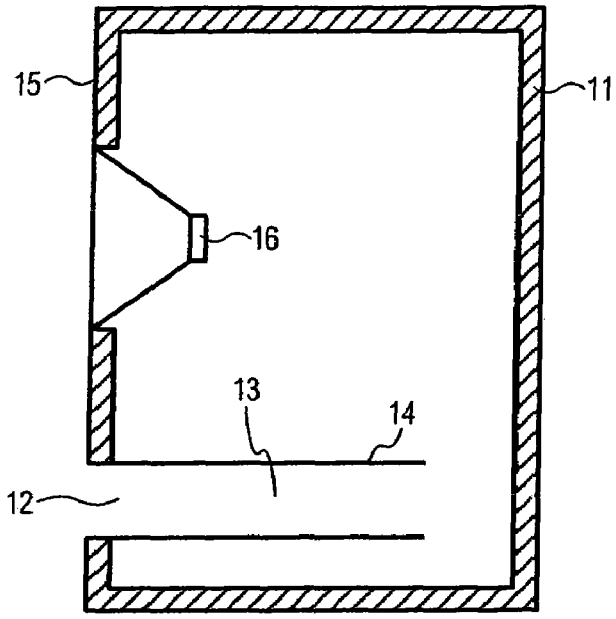
FIG. 1 (PRIOR ART)
FIG. 1 is a cross-sectional view of a prior art bass-reflex loudspeaker.

With reference to FIG. 1, a conventional bass-reflex loudspeaker system is shown. The system comprises an enclosure 11, a bass reflex port 14 with an outlet 12 and air volume 13 for resonating with respect to the enclosure air volume. A permanent magnet acoustic driver 16 is directly mounted to the front wall 15 of the enclosure 11. Due to the size of port 14, the enclosure 1 must be reasonably large compared to acoustic driver 6. The standard calculations used to determine the size of port 14 will give its acoustic area—the cross-sectional area in a plane perpendicular to the longitudinal axis of port 14—and total length.

Figure 2:
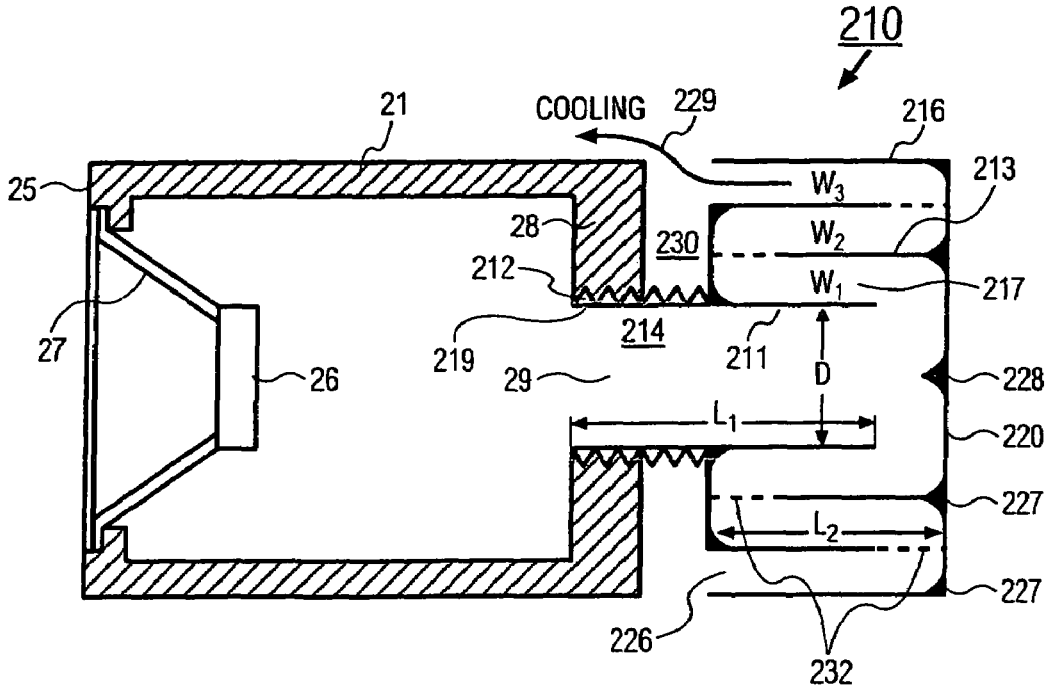
FIG. 2 is a cross sectional view of a first embodiment of the present invention.

FIGS. 2 and 3 illustrates a first embodiment of the present invention. Here there is an enclosure 21 having a permanent magnet acoustic driver 26 mounted in the front wall 25 of the enclosure 21. Other types of acoustic drivers may of course be employed. As can be seen, the front wall 25 is not much larger than the acoustic driver 26. Preferably, enclosure 21 is made of a heat conductive material. As the magnet assembly of acoustic driver 26, and the frame 27 of the acoustic driver 26, are made of metal and are therefore heat conductive, this enables the enclosure 21 to act as a dissipater of heat generated during, and by, the operation of acoustic driver 26.

Enclosure 21 has a rear wall 28 with a central opening 29. Preferably, central opening 29 is aligned and co-axial with acoustic driver 26. Mounted in central opening 29 and secured to rear wall 28 is an acoustic extension generally indicated as 210. The acoustic extension 210 is preferably co-axial with acoustic driver 26. The acoustic extension 210 may be any one of: a bass reflex port, a tuned port, a passive radiator and a concentric loading. For the remainder of the description it will be referred to as a "port" for simplicity.

As can be seen from FIGS. 2 and 3, the port 210 defines a serpentine passage operatively connected to the interior of the enclosure 21.

Port 210 has a central stem 211 that locates in opening 29 and engages with rear wall 28 using a threaded portion 212 on its outer surface, adhesives, screw fasteners, or the like. It is preferred that the engagement of central stem 211 and rear wall 28 is substantially air tight. It is also preferred for the central stem 211 to be adjustable relative to rear wall 28 to enable fine turning of the acoustic response of port 210 by moving the port 210 in the direction of the longitudinal axis of central stem 211. Central stem 211 may be moved axially inwardly or outwardly relative to rear wall 28.

The port 210 may also be removable from enclosure 21 to enable different ports 210 to be used for different acoustic responses, and also for transport and/or storage.

Central stem 211 is shown as being cylindrical. The effective length of central stem 211 from the inner surface of rear wall 28 to the end of central stem 211 remote from rear wall 28 is given as $L_1$. The acoustic area of central stem 211 (the cross sectional area in a plane perpendicular to the longitudinal axis) is determined from its diameter D.

In the case of a concentric loading, the total acoustic length of port 210 is increased beyond $L_1$ by providing a plurality of columns 213 arranged concentrically with and about central stem 211 and having an outlet 226. There may be any required number of columns 213—two, three, four, five, and so forth, depending on the total acoustic length needed for port 210. As shown in FIG. 3, in the illustrated embodiment there are three such columns 213—an inner column 215, an intermediate column 218 and an outer column 216. By having an odd number of columns 213 (3, 5, 7 etc) the outlet 226 faces forwards, a preferred result. Both the inner 215 and outer columns 216 are mounted to, and extend perpendicularly from, an outer wall 220 of the port 210 and towards an inner wall 221 of the port 210. Column 218 is mounted to and extends perpendicularly from the inner wall 221 and towards the outer wall 220.

Column 215 extends generally concentrically with central stem 211 and is of a length such that an air gap 222 of desired size exists between its free end 223 and inner wall 221. Column 218 extends generally concentrically with central stem 211 and column 215 and is of a length such that an air gap 224 of desired size exists between its free end 225 and outer wall 220. Column 216 extends generally concentrically with central stem 211 and columns 215, 218 and is of a length such that it extends from outer wall 220 to a plane of inner wall 221. However, an outlet air gap 226 is provided between column 216 and inner wall 221.

As such, the port 210 has two halves. The first half is inner wall 221 with walls 211 and 218. The other half is outer wall 220 with walls 215 and 216.

Wall 215 has an air gap 222 so it doesn't generally contact inner wall 221. Wall 218 has an air gap 224 so it doesn't generally contact outer wall 220. To provide a physical contact between the two halves and to keep them the necessary distance apart to create air gaps 222 and 224, each of walls 215 and 218 has a series of spaced-apart, axially-extending, small projections 232 that contact and are secured to inner wall 221 and outer wall 220 respectively. The projections 232 should be of a length to give the required air gaps 222 and 224; but are preferably of sufficiently small cross-sectional area and spacing that their interference in air movement, and the acoustic response, is negligible. Projections 232 may be integral with one or more of walls 215, 218, 220 and 221.

Additionally or alternatively, projections 232 may be formed on either or both of outer wall 220 and inner wall 221.

Figure 8:
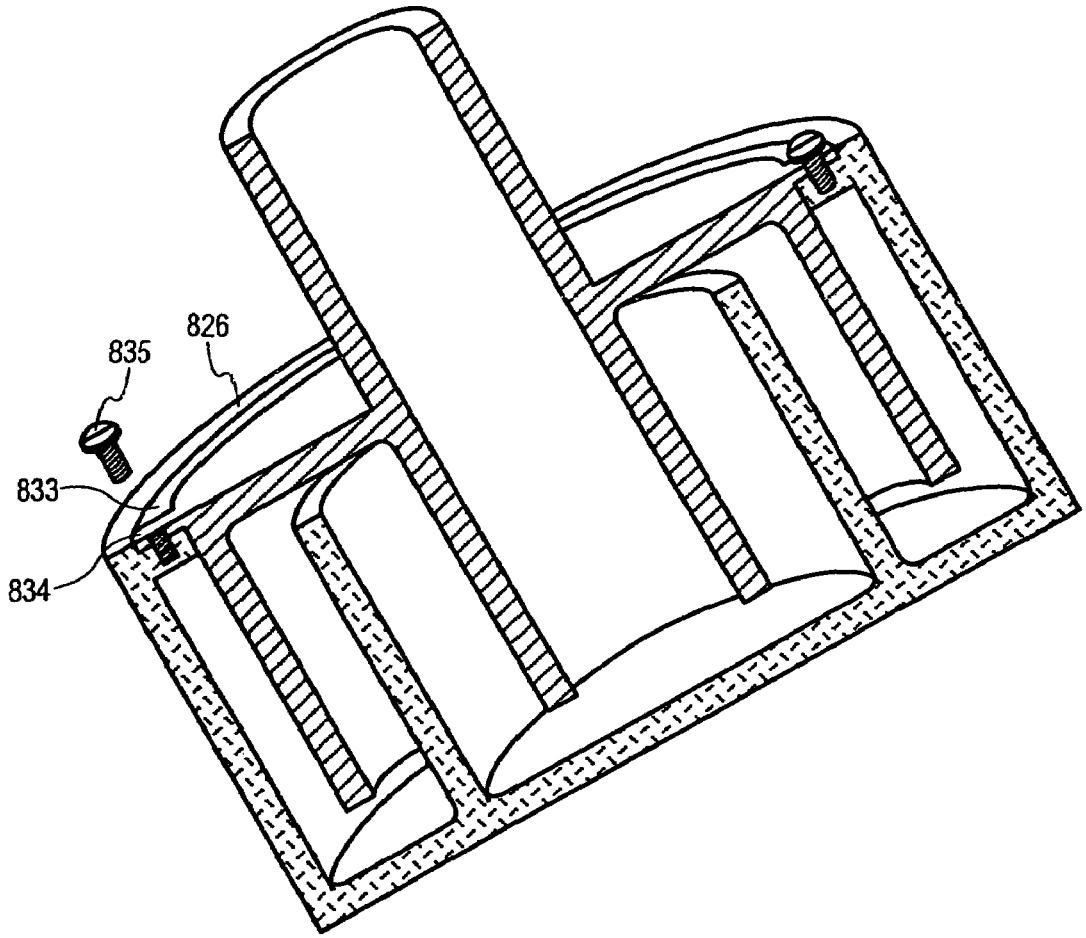
FIG. 8 is a variation on the embodiment of FIGS. 2 and 3.

As is shown in FIG. 8, the projections 832 may comprise a plurality of inner projections 833 that extend radially outwardly from inner wall 821, and a mating plurality of outer projections 834 that extend radially inwardly from outer wall 820 and overlap with projections 833. The projections 833, 834 may be secured together by a releasable fasteners such as, for example, a bolt or screw 835 (as shown), clips, adhesive tape, or otherwise; or non-releasably by, for example, glue, welding, or the like. The projections 833, 834 should be of a length to give the required air gap 826; but are preferably of sufficiently small cross-sectional area and spacing that their interference in air movement, and the acoustic response, is negligible.

There may be a gap 230 between inner wall 221 and rear wall 28. That gap 230 may be as little or as large as is required or desired.

As central stem 211 is cylindrical, columns 215, 218, 216 are preferably also cylindrical. In this way columns are mounted to walls 220, 221 in an alternating and opposed manner.

Central stem 211 defines an air volume 214 determined by D and $L_1$. The columns 215, 216, 218 define an air volume 217 defined by the acoustic area of the width $W_1$ from central stem 211 to column 215, and the axial length of $W_1$ ($L_2$, the distance between walls 220 and 221); the acoustic area of width $W_2$ from column 215 to column 218, and $L_2$; and the acoustic area of width $W_3$ from column 218 to column 216 and $L_2$.

The acoustic area of the width $W_1$ is the cross-sectional area in a plane perpendicular to the longitudinal axis and that is perpendicular to the plane of the page of FIG. 2. The acoustic area of $W_1$ is preferably the same as the acoustic area of the gap $W_2$; and the acoustic area of the gap $W_3$ is preferably the same as that of $W_1$ and $W_2$. Most preferably, the acoustic areas of D, $W_1$, $W_2$ and $W_3$ are all substantially identical.

Therefore, the total acoustic air volume of port 210 and thus the mass of air loading of port 210 is determined from:

D and $L_1$;

$W_1$ and $L_2$;

$W_2$ and $L_2$; and $W_3$ and $L_2$.

This can generally be designated as:

$$\tfrac{1}{4}(\pi D)^2 \times L_1 + \pi(W_1 + W_2 + W_3 \ldots W_n)^2 \times L_2$$

Preferably, air gaps 222 and 224 are the same size. As such, by providing a concentric port 210 a significantly greater length of port, and greater air volume, can be provided in a relatively small space. It can also be external of the speaker.

In operation, air will be drawn into central stem 211 through inlet end 219, will pass through air volume 214 within central stem, and air volume 217 within columns 215, 218, 216, and pass out through outlet 226 as outlet airflow 229. As such, air may be drawn into enclosure 21 to replace the lost air. Alternatively or additionally, air may oscillate back and forth as the driver. This will enhance the cooling of enclosure 21. Furthermore, air 229 passing out through outlet 226 will pass over at least part of enclosure 21 further increasing the cooling effect.

All junctions 227 between central stem 211 and inner wall 221, inner wall 221 and column 218, outer wall 220 and column 215, and outer wall 220 and column 216, preferably are curved or arcuate (as shown on FIG. 2) to reduce airflow restrictions, reduce airflow turbulence, and to reduce airflow noise. An appropriate conical projection 228 may be provided at the centre of outer wall 220 and extending towards central stem 211 for similar reasons. The radius of curvature of junctions 227 and conical projection 228 may be determined as is required, or desired.

The port 210 is external of enclosure 21 as it is not within the interior of enclosure 21 as occupied and used by acoustic driver 216.

As is described above, port 210 is generally cylindrical and has a circular cross-sectional shape. This is also shown in FIG. 4(*a*). It may be any other shape such as, for example, square (cuboid) (FIG. 4(*b*)); triangular (FIG. 4(*c*)) or octagonal (FIG. 4(*d*)). In addition, the columns forming the port 210 may also be tapered or flared, and the inner and outer walls 220, 221 of port 210 may be curved, stepped, or some other non-planar configuration.

Figure 5A:
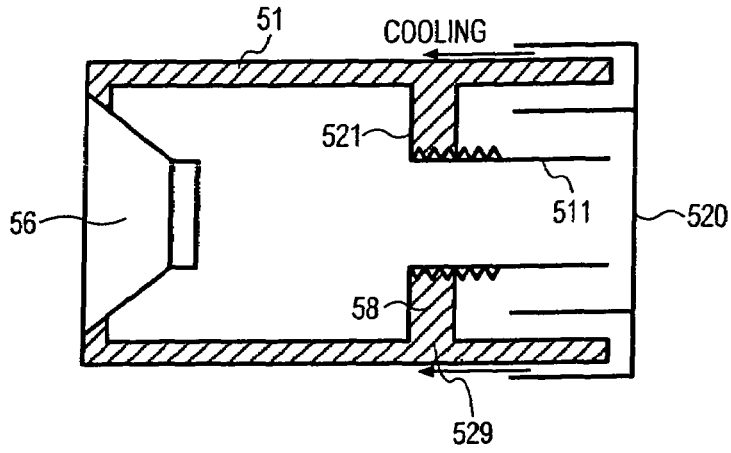
FIG. 5*a* is a cross-sectional view of a second embodiment of the present invention.
Figure 5B:
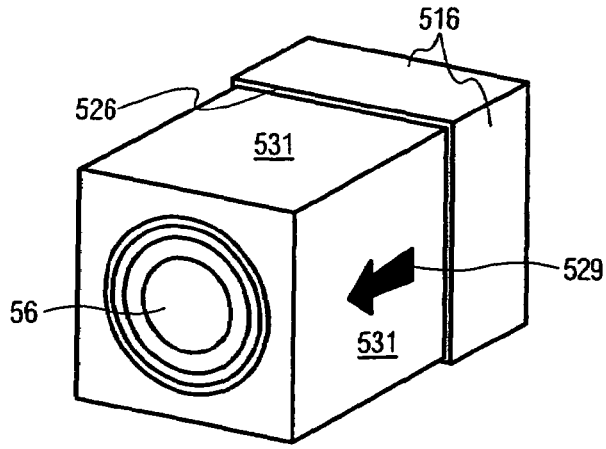
FIG. 5*b* is a perspective view from the front of the embodiment of FIG. 5*a;*
Figure 5C:
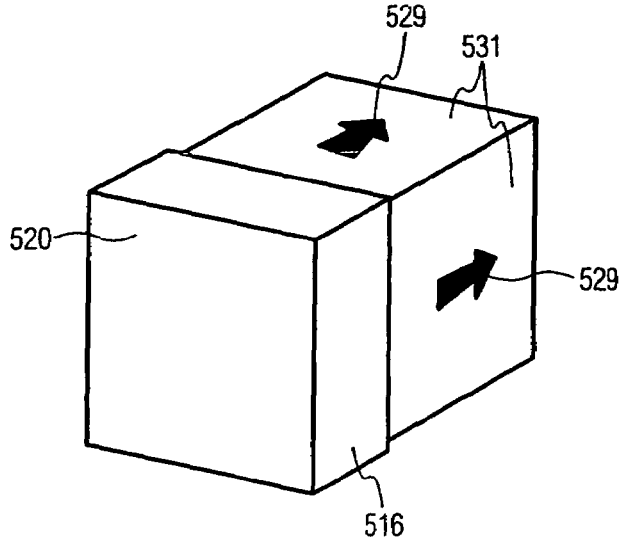
FIG. 5*c* is a perspective view from the rear of the embodiment of FIG. 5*a;*

FIG. 5 shows a variation where the inner wall 521 is the rear wall 58, and the four side walls 531 of enclosure 51 are extended to form intermediate column 518. As such, airflow 529 from outlet 526 will be over at least a part of each of the four sides 531.

Figure 6:
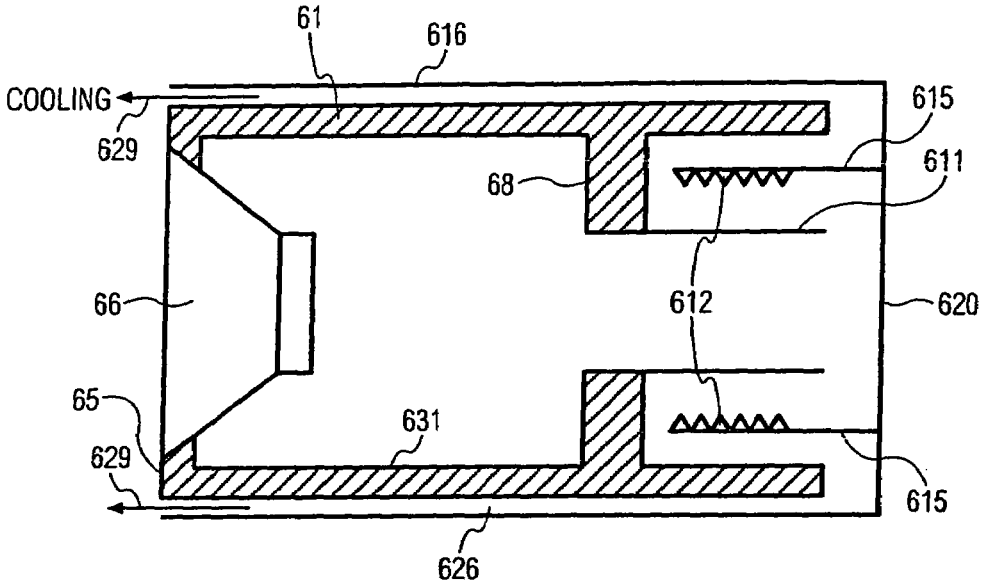
FIG. 6 is a cross-sectional view of a further embodiment.

FIG. 6 shows a variation over FIGS. 5. Here, column 616 has been extended in length so that outlet 626 is substantially planar with front wall 65. In this way the outlet air 629 passes completely over each of the four side walls 631 to thus increase the cooling effect. Also, central stem 611 is shown fixed to or integral with rear wall 68. In this case, column 615 may be adjustable relative to central stem 611 such as by use of screw threads 612.

Figure 7:
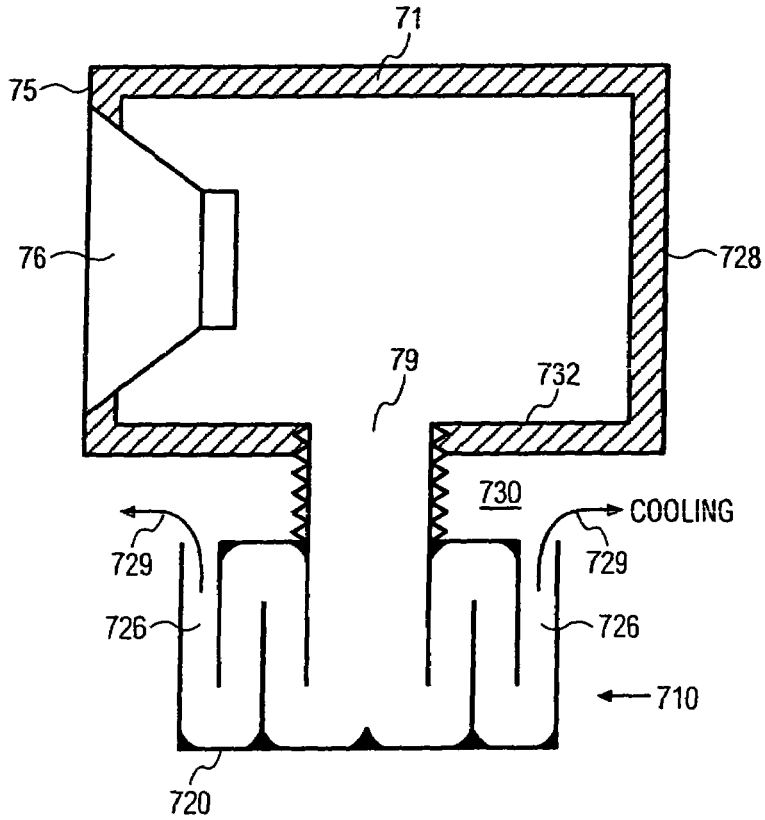
FIG. 7 is a cross-sectional view of a final embodiment.

FIG. 7 shows a variation of the previous embodiments. Although illustrated as a variation of the embodiment of FIGS. 2 and 3, the variations of one or more of FIGS. 4, 5 and 6 may also be incorporated into this embodiment. Here, opening 79 is in lower wall 732 of enclosure 71 with port 710 arranged below enclosure 71. Thus port 710 also acts as a stand or pedestal for enclosure 71. It is preferred for outlet 726 to be upwardly directed for audio clarity, and for gap 730 to be of a sufficient size for audio clarity.

As used herein, the terms "connected", "coupled", "amounted" etc. are synonymous, and do not imply any directness of mounting/coupling/connecting between the components so joined. That is, the coupling/connecting/mounting of components may be direct or indirect (i.e. involving intermediate components).

Whilst there has been described in the foregoing description a number of embodiments of the present invention, it will be understood by those skilled in the technology concerned that many variations or modifications in details of design and construction may be made without departing from the present invention.

The invention claimed is:

1. A speaker comprising:

(a) an enclosure with at least one wall;

(b) an acoustic driver being attached to a front wall of the enclosure; and (c) an acoustic extension being mounted to the enclosure, the acoustic extension being external of the enclosure and being operatively connected to an interior of the enclosure, wherein the acoustic extension comprises a central stem, and a plurality of columns each being generally concentric with the central stem; the plurality of columns being mounted to an outer wall of the acoustic extension and an inner wall of the acoustic extension in an alternating and opposed manner to define therebetween an airflow passage operatively connected to the central stem and the interior of the enclosure, and the plurality of columns comprises an intermediate column mounted to the inner wall and extending towards the outer wall, there being an air gap between a free end of the intermediate column and the outer wall.

2. A speaker as claimed in claim 1, wherein the acoustic extension defines a serpentine passage operatively connected to the interior of the enclosure.

3. A speaker as claimed in claim 1, wherein the acoustic extension is mounted in an opening in a rear wall of the enclosure and is generally co-axial with the acoustic driver.

4. A speaker as claimed in claim 1, wherein the plurality of columns further comprises an inner column mounted to the outer wall and extending towards the inner wall, there being an air gap between a free end of the inner column and the inner wall.

5. A speaker as claimed in claim 1, wherein the plurality of columns further comprises an outer column mounted to the outer wall and extending towards a plane of the inner wall, there being an outlet air gap between the outer column and the inner wall.

6. A speaker comprising;

(a) an enclosure with at least one wall;

(b) an acoustic driver being attached to a front wall of the enclosure; and (c) an acoustic extension being mounted to the enclosure, the acoustic extension being external of the enclosure and being operatively connected to an interior of the enclosure, wherein the acoustic extension comprises a central stem, and a plurality of columns each being generally concentric with the central stem; the plurality of columns being mounted to an outer wall of the acoustic extension and an inner wall of the acoustic extension in an alternating and opposed manner to define therebetween an airflow passage operatively connected to the central stem and the interior of the enclosure, wherein the plurality of columns comprises (i) an inner column mounted to the outer wall and extending towards the inner wall; there being an inner air gap between a free end of the inner column and the inner wall, (ii) an intermediate column mounted to the inner wall and extending towards the outer wall, there being an intermediate air gap between a free end of the intermediate column and the outer wall, and (iii) an outer column mounted to the outer wall and extending to a plane of the inner wall, there being an outlet air gap between the outer column and the inner wall.

7. A speaker as claimed in claim 5, wherein the outlet air gap faces towards the enclosure.

8. A speaker as claimed in claim 6, wherein the outlet air gap faces towards the enclosure.

9. A speaker as claimed in claim 1, wherein the acoustic extension is mounted in an opening in a rear wall of the enclosure and is generally co-axial with the acoustic driver.

10. A speaker as claimed in claim 4, wherein the acoustic extension is mounted in an opening in a rear wall of the enclosure and is generally co-axial with the acoustic driver.

11. A speaker as claimed in claim 5, wherein the acoustic extension is mounted in an opening in a rear wall of the enclosure and is generally co-axial with the acoustic driver.

12. A speaker as claimed in claim 6, wherein the acoustic extension is mounted in an opening in a rear wall of the enclosure and is generally co-axial with the acoustic driver.

13. A speaker as claimed in claim 1, wherein junctions between the plurality of columns and each of the outer wall and inner wall, are curved.

14. A speaker as claimed in claim 1, wherein the enclosure comprises four mutually perpendicular side walls, the four mutually perpendicular side walls being extended to comprise the intermediate column.

15. A speaker as claimed in claim 6, wherein the enclosure comprises four mutually perpendicular side walls, the four mutually perpendicular side walls being extended to comprise the intermediate column.

16. A speaker as claimed in claim 9, wherein the enclosure comprises four mutually perpendicular side walls, the four mutually perpendicular side walls being extended to comprise the intermediate column.

17. A speaker as claimed in claim 15, wherein the outer column extends forwardly to the vicinity of the front wall.

18. A speaker as claimed in claim 1, wherein the central stem defines an air volume, the air volume and the airflow passage being of a constant acoustic area.

19. A speaker as claimed in claim 1, wherein the enclosure and a frame of the acoustic driver are made of a heat conductive material.

20. A speaker as claimed in claim 17, wherein the enclosure and a frame of the acoustic driver are made of a heat conductive material.

21. A speaker as claimed in claim 6, wherein the enclosure and a frame of the acoustic driver are made of a heat conductive material.

22. A speaker as claimed in claim 1, wherein the acoustic extension is adjustable relative to the enclosure, the adjustment being in a direction of a longitudinal axis of the central stem.

23. A speaker as claimed in claim 1, wherein the acoustic extension is removably attached to the enclosure.

24. A speaker as claimed in claim 1, wherein the acoustic extension is selected from the group consisting of: a bass reflex port, a tuned port, a passive radiator, and a concentric loading.

25. A speaker as claimed in claim 1, wherein the central stem is mounted in an opening in a lower side wall of the enclosure, the acoustic extension acting as a pedestal for the enclosure.

26. An acoustic extension for attachment to a speaker, the acoustic extension comprising:

(a) a central stem; and (b) a plurality of columns each being generally concentric with the central stem, the plurality of columns being mounted to an outer wall and an inner wall of the acoustic extension in an alternating and opposed manner to define therebetween an airflow passage operatively connected to the central stem and operably connectable to an interior of the speaker, the acoustic extension being external of an enclosure of the speaker.

wherein the plurality of columns comprises an intermediate column mounted to the inner wall and extending towards the outer wall, there being an air gap between a free end of the intermediate column and the outer wall.

27. An acoustic extension as claimed in claim 26, wherein the plurality of columns further comprises an inner column mounted to the outer wall and extending towards the inner wall, there being an air gap between a free end of the inner column and the inner wall.

28. An acoustic extension as claimed in claim 26, wherein the plurality of columns further comprises an outer column mounted to the outer wall and extending to a plane of the inner wall, there being an outlet air gap between the outer column and the inner wall.

29. An acoustic extension for external attachment to a speaker, the acoustic extension comprising:

(a) a central stem; and (b) a plurality of columns each being generally concentric with the central stem; the plurality of columns being mounted to an outer wall of the acoustic extension and an inner wall of the acoustic extension in an alternating and opposed manner to define therebetween an airflow passage operatively connected to the central stem and the interior of the enclosure, wherein the plurality of columns comprises (i) an inner column mounted to the outer wall and extending towards the inner wall, there being an inner air gap between a free end of the inner column and the inner wall;

(ii) an intermediate column mounted to the inner wall and extending towards the outer wall, there being an intermediate air gap between a free end of the intermediate column and the outer wall; and (iii) an outer column mounted to the outer wall and extending to a plane of the inner wall, there being an outlet air gap between the outer column and the inner wall.

30. An acoustic extension as claimed in claim 27, wherein junctions between the plurality of columns and the outer wall and inner wall, are curved.

31. An acoustic extension as claimed in claim 26, wherein the central stem defines an air volume, the air volume and the airflow passage being of a constant acoustic area.

32. An acoustic extension as claimed in claim 26, wherein the acoustic extension is adjustable relative to the enclosure, the adjustment being in a direction of a longitudinal axis of the central stem.

33. An acoustic extension as claimed in claim 26, wherein the acoustic extension is removably attached to the enclosure.

34. An acoustic extension as claimed in claim 26, wherein the acoustic extension is selected from the group consisting of: a bass reflex port, a tuned port, a passive radiator, and a concentric loading.

35. A speaker comprising:

(a) an enclosure with at least one wall;

(b) an acoustic driver being attached to a front wall of the enclosure; and (c) an acoustic extension being mounted to the enclosure externally of the enclosure and being operatively connected to an interior of the enclosure, the enclosure and a frame of the acoustic driver being made of a heat conductive material, the acoustic extension having outlet air gap facing towards the enclosure to pass air over the enclosure to assist cooling of the enclosure, the acoustic extension including a plurality of columns comprises:

(i) an inner column mounted to the outer wall and extending towards the inner wall, there being an air gap between a free end of the inner column and the inner wall, (ii) an intermediate column mounted to the inner wall and extending towards the outer wall, there being an air gap between a free end of the intermediate column and the outer wall, and (iii) an outer column mounted to the outer wall and extending to a plane of the inner wall, there being an outlet air gap between the outer column and the inner wall.

36. A speaker as claimed in claim 35, wherein the enclosure comprises four mutually perpendicular side walls, the four mutually perpendicular side walls being extended to form the intermediate column.

37. A speaker as claimed in claim 35, wherein the outer column extends forwardly to a plane of the front wall.

38. A speaker as claimed in claim 35, wherein the acoustic extension is adjustable relative to the enclosure, the adjustment being in a direction of a longitudinal axis of the central stem.

39. A speaker as claimed in claim 35, wherein the acoustic extension is removably attached to the enclosure.

40. A speaker as claimed in claim 35, wherein the acoustic extension is selected from the group consisting of: a bass reflex port, a tuned port, a passive radiator, and a concentric loading.

* * * * *